US009757004B2

(12) United States Patent
Neumann et al.

(10) Patent No.: US 9,757,004 B2
(45) Date of Patent: Sep. 12, 2017

(54) LIQUID MANAGEMENT FOR FLOOR-TRAVERSING ROBOTS

(71) Applicant: iRobot Corporation, Bedford, MA (US)

(72) Inventors: Rogelio Manfred Neumann, Somerville, MA (US); Adam Daniel Leech, Melrose, MA (US); David Orrin Swett, Waltham, MA (US)

(73) Assignee: iRobot Corporation, Bedford, MA (US)

( * ) Notice: Subject to any disclaimer, the term of this patent is extended or adjusted under 35 U.S.C. 154(b) by 351 days.

(21) Appl. No.: 14/621,052

(22) Filed: Feb. 12, 2015

(65) Prior Publication Data

US 2016/0236343 A1 Aug. 18, 2016

(51) Int. Cl.

| | |
|---|---|
| ***A47L 11/40*** | (2006.01) |
| ***B25J 5/00*** | (2006.01) |
| ***B25J 11/00*** | (2006.01) |

(52) U.S. Cl.

CPC ..... *A47L 11/4025* (2013.01); *A47L 11/4072* (2013.01); *A47L 11/4075* (2013.01); *A47L 2201/00* (2013.01); *A47L 2201/06* (2013.01); *Y10S 901/01* (2013.01)

(58) Field of Classification Search

CPC ..... A47L 11/4025; A47L 11/4072; A47L 11/4075; A47L 2201/00; A47L 2201/06; Y10S 901/01

See application file for complete search history.

(56) References Cited

U.S. PATENT DOCUMENTS

| | | | |
|---|---|---|---|
| 2,769,882 | A | 11/1952 | Vitus et al. |
| 4,475,766 | A | 10/1984 | McKee |
| 4,807,921 | A | 2/1989 | Champie et al. |
| 4,892,351 | A | 1/1990 | Ono et al. |
| 6,008,621 | A | 12/1999 | Madison et al. |
| 6,095,871 | A | 8/2000 | Zahora et al. |
| 6,389,329 | B1 | 5/2002 | Colens |
| 6,532,404 | B2 | 3/2003 | Colens |
| 6,594,844 | B2 | 7/2003 | Jones |
| 6,690,134 | B1 | 2/2004 | Jones et al. |
| 6,781,338 | B2 | 8/2004 | Jones et al. |
| 6,809,490 | B2 | 10/2004 | Jones et al. |
| 6,965,209 | B2 | 11/2005 | Jones et al. |
| 7,155,308 | B2 | 12/2006 | Jones |
| 7,173,391 | B2 | 2/2007 | Jones et al. |
| 7,196,487 | B2 | 3/2007 | Jones et al. |
| 7,388,343 | B2 | 6/2008 | Jones et al. |

(Continued)

OTHER PUBLICATIONS

International Search Report and Written Opinion in International Application No. PCT/US15/61063, mailed Jan. 28, 2016, 16 pages.

*Primary Examiner* — Dung V Nguyen

(74) *Attorney, Agent, or Firm* — Fish & Richardson P.C.

(57) ABSTRACT

An autonomous floor-traversing robot includes: a wheeled body including a chassis and at least one motorized wheel configured to propel the chassis across a floor, the chassis defining an interior compartment disposed beneath a chassis ceiling; a cover extending across at least a central area of the chassis ceiling; and a graspable handle connected to the chassis and located outside the cover so as to be accessible from above the robot, the handle arranged to enable lifting of the robot. The chassis ceiling defines drainage channels configured to conduct the liquid away from the central area of the chassis ceiling.

28 Claims, 8 Drawing Sheets

(56) References Cited

U.S. PATENT DOCUMENTS

| | | | |
|---|---|---|---|
| 7,389,156 | B2 | 6/2008 | Ziegler et al. |
| 7,448,113 | B2 | 11/2008 | Jones et al. |
| 7,571,511 | B2 | 8/2009 | Jones et al. |
| 7,636,982 | B2 | 12/2009 | Jones et al. |
| 7,761,954 | B2 | 7/2010 | Ziegler et al. |
| 8,162,552 | B2 | 4/2012 | Rak et al. |
| D659,311 | S | 5/2012 | Geringer et al. |
| D660,530 | S | 5/2012 | Geringer et al. |
| 8,239,992 | B2 | 8/2012 | Schnittman et al. |
| D670,877 | S | 11/2012 | Geringer et al. |
| 8,347,444 | B2 | 1/2013 | Schnittman et al. |
| 8,370,985 | B2 | 2/2013 | Schnittman et al. |
| D699,010 | S | 2/2014 | Gilbert |
| 8,839,477 | B2 | 9/2014 | Schnittman et al. |
| D716,510 | S | 10/2014 | Gilbert |
| 8,881,339 | B2 | 11/2014 | Gilbert et al. |
| 8,955,192 | B2 | 2/2015 | Gilbert et al. |
| D728,877 | S | 5/2015 | Therrien |
| 2002/0016649 | A1 | 2/2002 | Jones |
| 2002/0120364 | A1 | 8/2002 | Colens |
| 2003/0025472 | A1 | 2/2003 | Jones et al. |
| 2004/0020000 | A1 | 2/2004 | Jones |
| 2004/0049877 | A1 | 3/2004 | Jones et al. |
| 2004/0187457 | A1 | 9/2004 | Colens |
| 2004/0207355 | A1 | 10/2004 | Jones et al. |
| 2005/0015914 | A1 | 1/2005 | You et al. |
| 2005/0067994 | A1 | 3/2005 | Jones et al. |
| 2005/0204717 | A1 | 9/2005 | Colens |
| 2007/0266508 | A1 | 11/2007 | Jones et al. |
| 2008/0140255 | A1 | 6/2008 | Ziegler et al. |
| 2008/0155768 | A1 | 7/2008 | Ziegler et al. |
| 2008/0307590 | A1 | 12/2008 | Jones et al. |
| 2009/0108636 | A1 | 4/2009 | Hanson et al. |
| 2010/0049365 | A1 | 2/2010 | Jones et al. |
| 2010/0257690 | A1 | 10/2010 | Jones et al. |
| 2010/0257691 | A1 | 10/2010 | Jones et al. |
| 2010/0263158 | A1 | 10/2010 | Jones et al. |
| 2011/0203072 | A1 | 8/2011 | Veenstra |

LIQUID MANAGEMENT FOR FLOOR-TRAVERSING ROBOTS

TECHNICAL FIELD

This disclosure relates to floor-traversing robots, and more particularly to protecting internal components of such robots from liquid damage.

BACKGROUND

Modern-day autonomous robots can perform numerous desired tasks in unstructured environments without continuous human guidance. Many kinds of floor-traversing robots, for example, are autonomous to some degree with respect to navigation, and therefore may encounter unexpected hazards during unsupervised autonomous missions. Hazards resulting in a liquid (water, coffee, or juice, for example) being spilled on the robot may be particularly problematic if the liquid comes into contact with the electronics autonomously controlling the robot.

SUMMARY

In one aspect of the present disclosure, an autonomous floor-traversing robot includes: a wheeled body including a chassis and at least one motorized wheel configured to propel the chassis across a floor, the chassis defining an interior compartment disposed beneath a chassis ceiling; a cover extending across at least a central area of the chassis ceiling; and a graspable handle connected to the chassis and located outside the cover so as to be accessible from above the robot, the handle arranged to enable lifting of the robot. The chassis ceiling defines a primary drainage channel outside the cover configured to catch liquid from an outer surface of the cover and conduct the liquid away from the central area.

In some embodiments, the handle is pivotally coupled to the chassis and extends over a mounting bay defined in the chassis ceiling. In some examples, a floor of the mounting bay includes one or more drainage gutters to direct liquid from within the mounting bay out of the robot.

In some embodiments, the handle is mounted to the chassis at a position offset from the robot's center of gravity, such that the robot tilts when lifted.

In some embodiments, the chassis ceiling defines at least one secondary drainage channel extending beneath the cover and configured to conduct away from the central area. In some examples, the secondary drainage channel extends from a corner of a mounting bay retaining the handle. In some examples, the secondary drainage channel is defined by a plurality of struts extending integrally from a surface of the chassis ceiling to support the cover atop the chassis. In some examples, the secondary drainage channel defines an arcuate path leading across the chassis without traversing the central area. In some implementations, the arcuate path of the secondary drainage channel leads to a downwardly sloped egress region near a back end of the chassis. In some applications, the egress region leads to an opening to the interior of a cleaning bin of the robot. In some examples, the secondary drainage channel is downwardly sloped along a radial direction from the center of the chassis, so as to guide liquid away from the central area when the robot placed substantially flat on the floor.

In some embodiments, the primary drainage channel includes a circular race surrounding the cover.

In some embodiments, the primary drainage channel includes a recessed lower surface of the chassis ceiling traced by a raised outer rim of the body. In some examples, the cover is surrounded by the outer rim, and the primary drainage channel is configured to conduct the liquid towards a discharge gap formed in the outer rim.

In some embodiments, a lower surface of the primary drainage channel is downwardly sloped along a radial direction from the center of the chassis, so as to guide liquid to egress from the robot through an area along a side of the robot when the robot is placed substantially flat on the floor.

In some embodiments, the cover is removably coupled to the chassis ceiling.

In some embodiments, the cover includes a continuous sealing lip tracing an edge of the chassis ceiling when the cover is coupled to the chassis ceiling. In some examples, the cover further includes a plurality of locking tabs distributed intermittently along an inner face of the sealing lip to grip the edge of the chassis ceiling.

In some embodiments, the robot further includes a button plate coupled to an inner surface of the cover, the button plate including: a substantially flat base; a grommet situated within the base, the grommet including a flexible diaphragm; and a disk retained by an inner flange of the grommet, the disk positioned above an activatable mechanical button disposed beneath the chassis ceiling.

In some embodiments, an outer surface of the cover defines a domed contour sloping downwardly toward the primary drainage channel.

In yet another aspect of the present disclosure, an autonomous floor-traversing robot includes: a wheeled chassis including a chassis housing and at least one motorized wheel configured to propel the chassis across a floor, the chassis defining an interior compartment disposed beneath a chassis ceiling; a cover extending across at least a central area of the chassis ceiling; and a graspable handle connected to the chassis and located outside the cover so as to be accessible from above the robot, the handle arranged to enable lifting of the robot. The chassis ceiling has an upper surface defining one or more open drainage channels extending beneath the cover from a corner of a mounting bay retaining the handle and configured to conduct liquid toward an edge region of the robot.

In some embodiments, at least one of the drainage channels is defined by a plurality of struts extending integrally from a surface of the chassis ceiling to support the cover atop the chassis.

In some embodiments, at least one of the drainage channels defines an arcuate path leading across the chassis without traversing the central area. In some examples, the arcuate path leads to a downwardly sloped egress region near a back end of the chassis. In some implementations, the egress region leads to an opening to the interior of a cleaning bin of the robot.

In some embodiments, at least one of the drainage channels is located radially inwards of a primary drainage channel outside the cover configured to catch liquid from an outer surface of the cover and conduct the liquid away from the central area.

In some embodiments, at least one of the drainage channels is downwardly sloped along a radial direction from the center of the chassis, so as to guide liquid away from the central area when the robot placed substantially flat on the floor.

In yet another aspect of the present disclosure, an autonomous floor-traversing robot includes: a wheeled chassis including a chassis housing and at least one motorized wheel configured to propel the chassis across a floor, the chassis defining an interior compartment disposed beneath a chassis ceiling; a cover extending across at least a central area of the chassis ceiling; and a button plate coupled to an inner surface of the cover. The button plate includes: a substantially flat base; a grommet situated within the base, the grommet including a flexible diaphragm; and a disk retained by an inner flange of the grommet, the disk positioned above an activatable mechanical button disposed beneath the chassis ceiling.

In some embodiments, the disk is formed from a material that is substantially more rigid than a material of the flexible diaphragm.

In some embodiments, the base and the grommet include a unitary structure manufactured from an elastomeric polymer material.

In some embodiments, the button plate is aligned with an opening of the chassis ceiling exposing a mechanical button, with the flexible diaphragm of the grommet and the disk being configured to be received within the opening so as to reach the mechanical button when the disk is pressed downward by a user.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
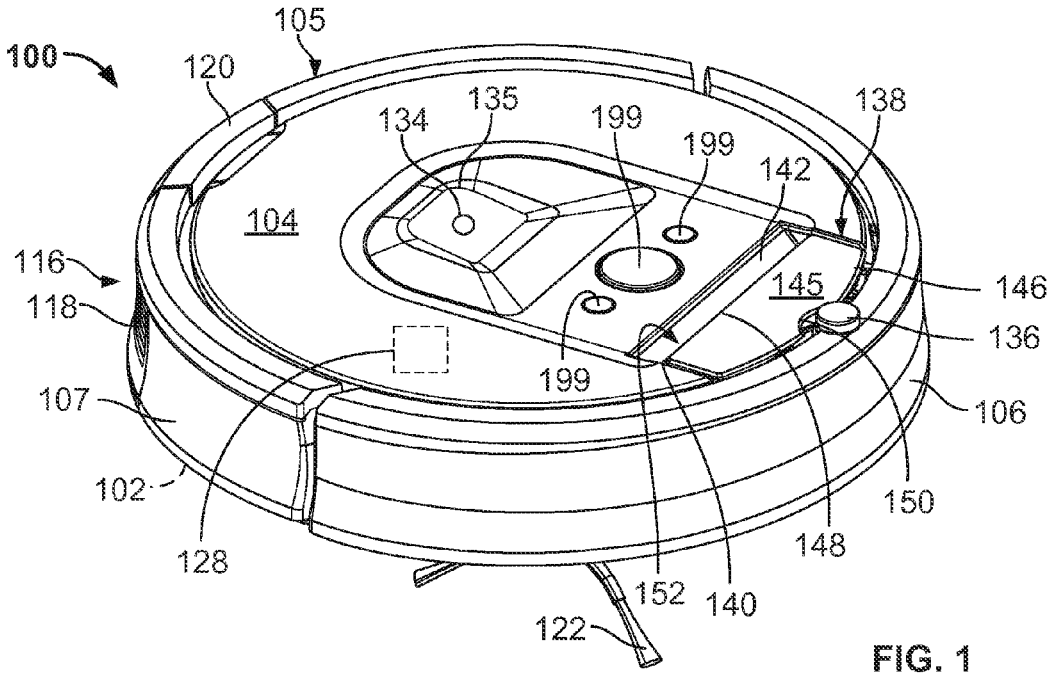
FIG. 1 is a perspective view of an example floor-traversing robot.

During use, autonomous robots can encounter unexpected hazards including liquid (water, coffee, or juice, for example) being spilled or otherwise deposited on the robot. For example, if a vase or glass of water is placed near the edge of a table and the robot bumps into the table, the water could potentially spill onto the top surface of the robot. Such hazards resulting in a liquid being spilled on the robot may be particularly problematic if the liquid comes into contact with the electronics autonomously controlling the robot. For instance, liquids can short or otherwise cause a controller circuit board included in the robot to fail or operate improperly. Systems, components, and methods described herein can help to lessen the likelihood that liquid deposited (e.g., spilled) on the top surface of the robot will migrate to the circuit boards or other components that could potentially fail or malfunction due to contact with the liquid.

In some examples, to lessen the likelihood that liquid spilled on the top surface of the robot will migrate to the internal components, the robot includes a contoured protective cover and one or more drainage channels that cooperate to cause liquid to safely egress from the robot (e.g., flow off the sides of the robot and onto the floor). For example, the cover may direct the liquid into a primary drainage channel that surrounds the cover like a moat, and the primary drainage channel may guide the liquid to egress from the robot chassis without contacting any liquid-sensitive components. In some situations, rogue liquid may migrate past a sealing lip of the protective cover. Accordingly, a top surface of the robot chassis (e.g., a chassis ceiling) to which the cover is attached includes one or more secondary drainage channels extending beneath the cover. The secondary drainage channels are designed to guide or "channel" the liquid across the chassis ceiling to a safe egress point while preventing the liquid from entering an internal compartment of the robot chassis where the electronics are housed. In some examples, the raised edges which define the secondary drainage channels are provided by one or more struts that support the protective cover atop the chassis ceiling. In some examples, the secondary drainage channels can lead from locations where the liquid is most likely to migrate past the robot's protective cover to a sloped egress region where the liquid is unlikely to cause significant damage. For instance, a secondary drainage channel could lead from the edge of a mounting bay supporting the robot's handle at the front of the robot to an egress region at the back of the robot, such that the liquid is safely deposited into the robot's cleaning bin. The cleaning bin may become fouled in this case, but the more critical electronic components are preserved. Further, in some examples, a secondary drainage channel can direct the liquid radially outward towards the edge of the cover and away from a central region of the chassis where there are openings in the robot chassis exposing the internal electronics (e.g., openings exposing mechanical buttons or sensors).

In some examples, the protective cover can include one or more specially designed pressable buttons that prevent liquid from seeping past the protective cover in areas surrounding the buttons. For example, the protective cover can be fitted with a liquid-tight button plate that aligns with openings in the robot chassis that expose mechanical buttons.

The button plate can include one or more grommets and one or more disks retained by the respective grommets. In some examples, the grommets may include flexible diaphragms that allow the disks to be pushed down into contact with the mechanical buttons by a user. When a disk is depressed down in\to contact with a mechanical button, the diaphragm flexes, but no fluid can seep or penetrate through the flexible seal.

Figure 2:
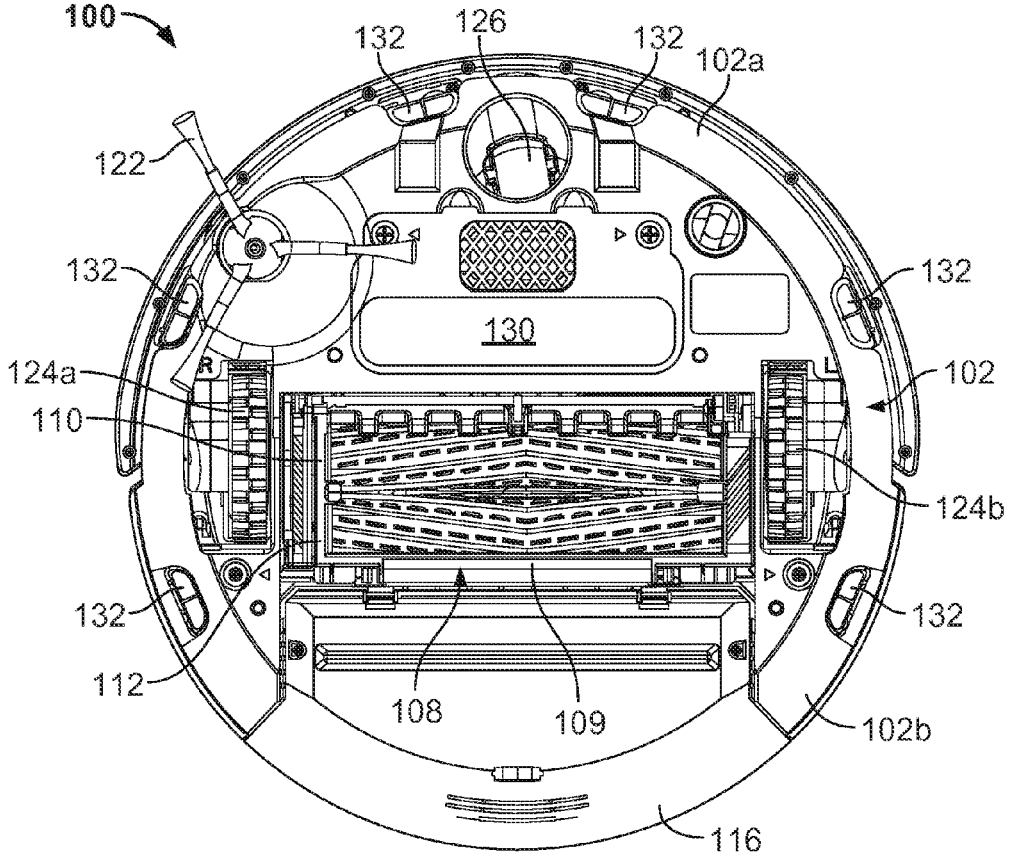
FIG. 2 is a bottom view of the robot of FIG. 1.

FIGS. 1 and 2 illustrate an example floor-traversing robot 100. In this example, the robot 100 is provided in the form of a mobile floor cleaning robot, which may be designed to autonomously traverse and clean a floor surface. The robot 100 includes a main chassis 102 defining an interior compartment (not shown) disposed beneath a chassis ceiling 154 (see FIGS. 4A and 4B). The interior compartment can house various components of the robot such as the cleaning head assembly 108 and the robot controller circuit 128, each of which are described in more detail herein. Some of the components housed inside the interior compartment of the main chassis may be susceptible to damage or failure if a significant amount of water comes into contact with the components. In order to lessen the likelihood of water entering the interior compartment of the main chassis 102, the chassis 102 carries a detachable protective cover 104 extending across a portion of the chassis ceiling 154. In the current example of a generally circular robot, the detachable protective cover 104 is generally circular and configured to fit within a raised outer rim 105 at the edge of the robot 100. In this example, the outer rim 105 is a discontinuous structure formed by portions of a forward bumper 106, a rear wall 107, and a cleaning bin release mechanism 120. Thus, the protective cover 104 does not extend to the very edge of the robot, but rather extends to a location near the edge of the robot. For example, the protective cover 104 is located inside of the bumper 106.

The robot 100 may move in both forward and reverse drive directions; accordingly, the chassis 102 has corresponding forward and back ends 102*a*, 102*b*. The bumper 106 is mounted at the forward end 102*a* and faces the forward drive direction. Upon identification of furniture and other obstacles, the robot 100 can slow its approach and lightly and gently touch the obstacle with its bumper and then change direction to avoid further contact with the obstacle. In some embodiments, the robot 100 may navigate in the reverse direction with the back end 102*b* oriented in the direction of movement, for example during escape, bounce, and obstacle avoidance behaviors in which the robot 100 drives in reverse.

A cleaning head assembly 108 is located in a roller housing 109 coupled to a middle portion of the chassis 102. The cleaning head assembly 108 is mounted in a cleaning head frame (not shown) attachable to the chassis 102. The cleaning head frame supports the roller housing 109. The cleaning head assembly 108 includes a front roller 110 and a rear roller 112 rotatably mounted parallel to the floor surface and spaced apart from one another by a small elongated gap. The front 110 and rear 112 rollers are designed to contact and agitate the floor surface during use. In this example, each of the rollers 110, 112 features a pattern of chevron-shaped vanes distributed along its cylindrical exterior. Other suitable configurations, however, are also contemplated. For example, in some embodiments, at least one of the front and rear rollers may include bristles and/or elongated pliable flaps for agitating the floor surface.

Each of the front 110 and rear 112 rollers is rotatably driven by a brush motor (not shown) to dynamically lift (or "extract") agitated debris from the floor surface. A robot vacuum (not shown) disposed in a cleaning bin 116 towards the back end 102*b* of the chassis 102 includes a motor driven fan (not shown) that pulls air up through the gap between the rollers 110, 112 to provide a suction force that assists the rollers in extracting debris from the floor surface. Air and debris that passes through the roller gap is routed through a plenum that leads to the cleaning bin 116. Air exhausted from the robot vacuum is directed through an exhaust port 118. In some examples, the exhaust port 118 includes a series of parallel slats angled upward, so as to direct airflow away from the floor surface. This design prevents exhaust air from blowing dust and other debris along the floor surface as the robot 100 executes a cleaning routine. The cleaning bin 116 is removable from the chassis 102 by a spring-loaded release mechanism 120.

Installed along the sidewall of the chassis 102, proximate the forward end 102*a* and ahead of the rollers 110, 112 in a forward drive direction, is a side brush 122 rotatable about an axis perpendicular to the floor surface. The side brush 122 allows the robot 100 to produce a wider coverage area for cleaning along the floor surface. In particular, the side brush 122 may flick debris from outside the area footprint of the robot 100 into the path of the centrally located cleaning head assembly.

Installed along either side of the chassis 102, bracketing a longitudinal axis of the roller housing 109, are independent drive wheels 124*a*, 124*b* that mobilize the robot 100 and provide two points of contact with the floor surface. The forward end 102*a* of the chassis 102 includes a non-driven, multi-directional caster wheel 126 which provides additional support for the robot 100 as a third point of contact with the floor surface.

A robot controller circuit 128 (depicted schematically) is carried by the chassis 102. In some examples, the controller circuit 128 is mounted on a printed circuit board (PCB), which carries a number of computing components (e.g., computer memory and computer processing chips, input/output components, etc.), and is attached to the chassis 102 in the interior compartment below the chassis ceiling 154. The robot controller circuit 128 is configured (e.g., appropriately designed and programmed) to govern over various other components of the robot 100 (e.g., the rollers 110, 112, the side brush 122, and/or the drive wheels 124*a*, 124*b*). As one example, the robot controller circuit 128 may provide commands to operate the drive wheels 124*a*, 124*b* in unison to maneuver the robot 100 forward or backward. As another example, the robot controller circuit 128 may issue a command to operate drive wheel 124*a* in a forward direction and drive wheel 124*b* in a rearward direction to execute a clock-wise turn. Similarly, the robot controller circuit 128 may provide commands to initiate or cease operation of the rotating rollers 110, 112 or the side brush 122. For example, the robot controller circuit 128 may issue a command to deactivate or reverse bias the rollers 110, 112 if they become tangled. In some embodiments, the robot controller circuit 128 is designed to implement a suitable behavior-based-robotics scheme to issue commands that cause the robot 100 to navigate and clean a floor surface in an autonomous fashion. The robot controller circuit 128, as well as other components of the robot 100, may be powered by a battery 130 disposed on the chassis 102 forward of the cleaning head assembly 108.

The robot controller circuit 128 implements the behavior-based-robotics scheme in response to feedback received from a plurality of sensors distributed about the robot 100 and communicatively coupled to the robot controller circuit 128. For instance, in this example, an array of proximity sensors (not shown) are installed along the periphery of the robot 100, including the front end bumper 106. The proximity sensors are responsive to the presence of potential obstacles that may appear in front of or beside the robot 100 as the robot moves in the forward drive direction. The robot 100 further includes an array of cliff sensors 132 installed along bottom of the chassis 102. The cliff sensors 132 are designed to detect a potential cliff, or flooring drop, forward of the robot 100 as the robot 100 moves in the forward drive direction. More specifically, the cliff sensors 132 are responsive to sudden changes in floor characteristics indicative of an edge or cliff of the floor surface (e.g., an edge of a stair).

The robot still further includes a visual sensor 134 aligned with a substantially transparent viewport 135 of the otherwise opaque protective cover 104. In some examples, the visual sensor 134 is provided in the form of a digital camera having a field of view optical axis oriented in the forward drive direction of the robot, for detecting features and landmarks in the operating environment and building a map, for example, using VSLAM technology. In the current example, the viewport 135 has a rounded rectangular shape with a viewing area of about 1,500 $mm^2$ to about 2,000 $mm^2$ (e.g., about 1,600 $mm^2$ to about 1,800 $mm^2$). In some examples, a ratio of the area of the viewport 135 to the area of the entire protective cover is from about 1:32 to about 1:31. In some examples, the viewport 135 is provided having a convex contour which may be incorporated in the overall domed shape of the cover 104, may facilitate the shedding of spilled liquid away from the viewport to keep the field of view of the visual sensor 134 unobstructed.

Various other types of sensors, though not shown or described in connection with the illustrated examples, may also be incorporated in the robot 100 without departing from the scope of the present disclosure. For example, a tactile sensor responsive to a collision of the bumper 106 and/or a brush-motor sensor responsive to motor current of the brush motor may be incorporated in the robot 100.

A communications module 136 mounted at the forward end 102*a* of the chassis 102 and communicatively coupled to the robot controller circuit 128. In some embodiments, the communications module is operable to send and receive signals to and from a remote device. For example, the communications module 136 may detect a navigation signal projected from an emitter of a navigation or virtual wall beacon or a homing signal projected from the emitter of a docking station. Docking, confinement, home base, and homing technologies discussed in U.S. Pat. Nos. 7,196,487; 7,188,000, U.S. Patent Application Publication No. 20050156562, and U.S. Patent Application Publication No. 20140100693 (the entireties of which are hereby incorporated by reference) describe suitable homing-navigation and docking technologies.

Figure 3:
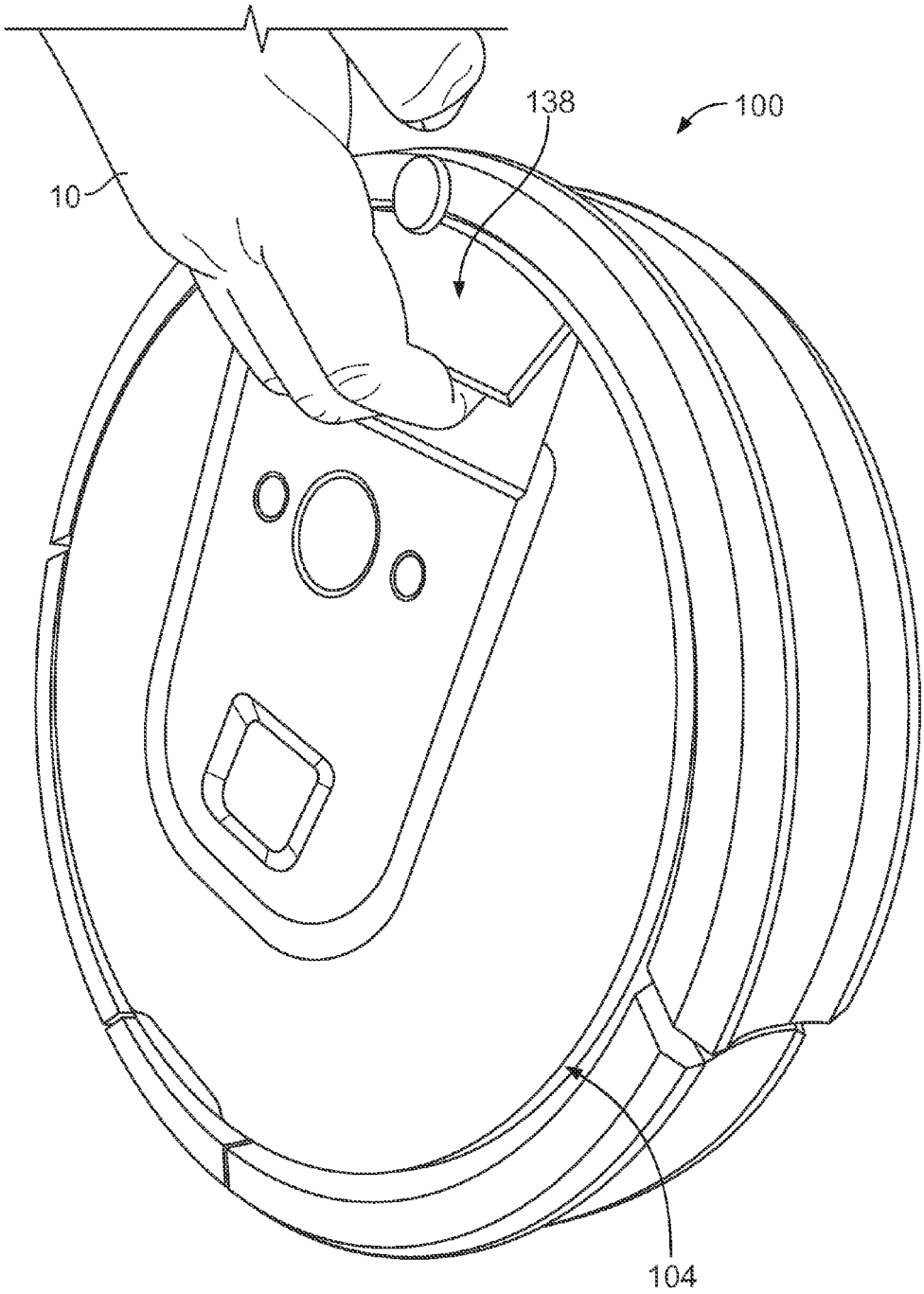
FIG. 3 is a perspective view of the robot of FIG. 1 being lifted by a user grasping a handle coupled to the robot chassis.

As shown in FIG. 1, the robot 100 further includes a handle 138 accessible from above the robot 100, and particularly arranged to be graspable by a user to lift the robot 100. In this example, the handle 138 is mounted at the forward end 102*a* of the chassis 102. Because the handle 138 is laterally offset from the center of gravity of the robot 100, the robot tilts out of the horizontal plane when lifted, as illustrated in FIG. 3. As discussed below, this tilting of the robot 100 may facilitate the flow of liquid through one or more drainage channels that lead away from various liquid-sensitive components housed below the chassis ceiling 154 (e.g., the controller circuit 128 and any other electrical components).

Returning to FIG. 1, the handle 138 is aligned with a rectangular slot opening 140 of the circular protective cover 104, and secured to the chassis 102 at the floor 144 (see FIG. 5) of a mounting bay 142 recessed from the upper surface 156 (see FIG. 5) of the chassis ceiling 154. The top surface 145 of the handle 138 is substantially flat and, with the handle at rest (e.g., not being pulled by a user), substantially level with the outer surface of the cover 104 to provide an aesthetic flush-mounted appearance and to aid in mobility by lessening the likelihood of the handle become entangled or snagged by obstacles in the environment. In this example, the handle 138 is pivotally coupled to the floor 144 of the chassis mounting bay 142 at a fulcrum such that the forward edge 146 of the handle tilts inward into the mounting bay and the rear edge 148 tilts outward from the mounting bay when the handle 138 is pulled by a user 10 (see FIG. 3). In some examples, the handle 138 can have a maximum tilt angle of up to 60 degrees (e.g., movable from 0 degrees to about 60 degrees, movable from 0 degrees to about 45 degrees, movable from 0 degrees to about 30 degrees).

As shown, the shape of the forward edge 146 of the handle 138 matches the curved contour of the bumper 106 and includes a small concave notch 150 to accommodate the communications module 136, which provides sufficient clearance for the pivoting movement of the handle (see FIG. 3). The rear edge 148 of the handle 138 is substantially straight and spaced apart from the edge of the mounting bay 142 and the cover 104, providing a gap 152 of sufficient size to allow the user 10 to slip his/her fingers under then handle to grasp it (see FIG. 3). For example, the gap 152 can provide between 1-3 cm of space between the edge of the handle and the mounting bay 142 when the handle is not in use. Thus, the handle has one generally straight edge and an opposing arcuate edge.

Figure 4A:
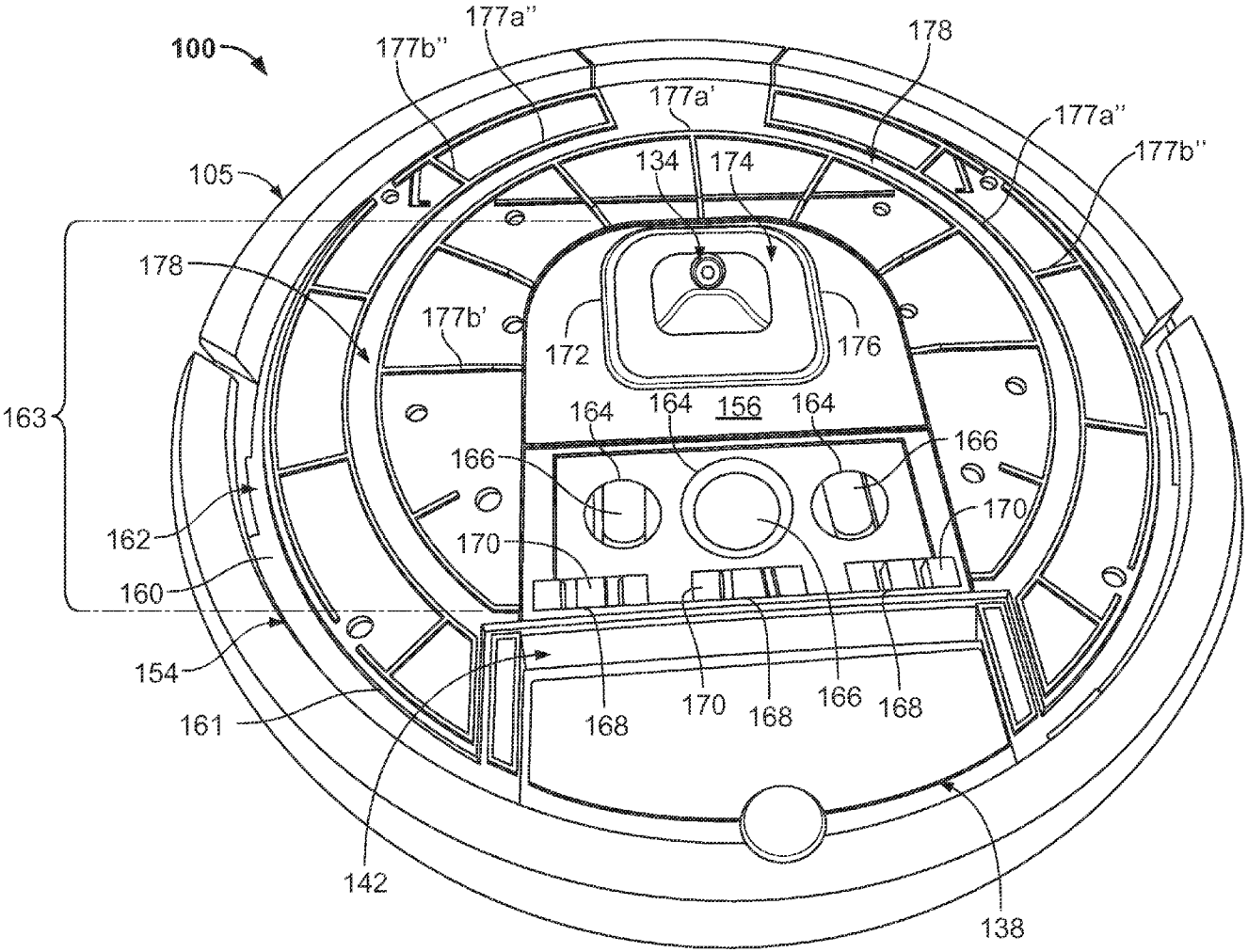
FIG. 4A is a perspective top view of the robot of FIG. 1 depicted with the protective cover removed to expose the ceiling of the robot chassis.
Figure 5:
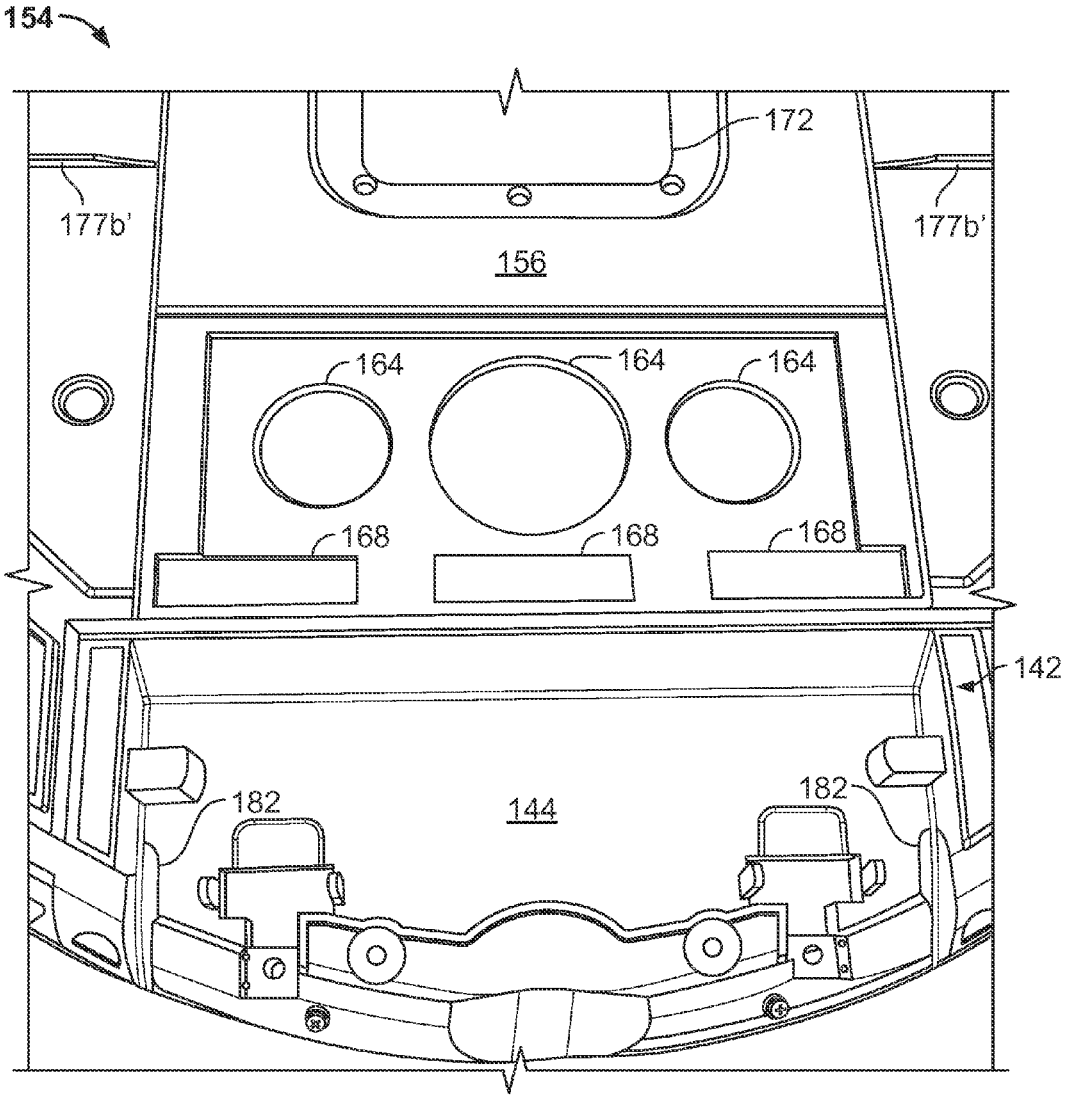
FIG. 5 is an enlarged view of a portion of the top side of the ceiling of the robot chassis.

Referring now to FIGS. 4A and 5, the chassis ceiling 154 is designed to facilitate drainage of liquid from the robot 100 along defined drainage channels. In various examples, the drainage channels facilitate the egress of liquid from the robot when the robot is flat and/or when the robot is lifted by the handle 138. The drainage channels lead away from liquid-sensitive components housed in the compartment below the chassis ceiling. In the example shown in FIG. 4A, there are two drainage channels or paths (e.g., a primary drainage channel 162 and a secondary drainage channel 178) for guiding liquid spilled on the robot away from liquid-sensitive components housed in the interior compartment of the chassis. As described in more detail below, the first path is located outside of the protective cover toward the edge of the robot near the outer rim, and is configured to "catch" liquid that runs off a domed outer surface of the cover; and the second path includes two sidewalls defined by struts supporting the cover atop the chassis ceiling, and is configured to guide liquid that migrates beneath the cover around the central portion of the chassis ceiling towards a sloped egress region on the backside of the robot near the cleaning bin.

In this example, the ceiling 154 includes a raised upper surface 156 and a recessed lower surface 160 that forms a flange-like ring surrounding the upper surface. The lower surface 160 of the ceiling 154 provides the base of a primary drainage channel 162 formed between a plateaued edge 161 of the chassis ceiling separating the upper surface from the lower surface and the robot's outer rim 105. As described below, the protective cover 104 is removably attached to the upper surface 156 of the ceiling 154, leaving the lower surface 160 (the base of the primary drainage channel) exposed outside the cover 104. Thus, in the illustrated example, the primary drainage channel 162 forms a circular race around the outside of the protective cover 104 like a moat to catch liquid shed from the top surface of the cover. In some examples, the depth of the primary drainage channel 162 is between about 0.3 cm and 0.6 cm (e.g., between about 0.4 cm and 0.5cm, or about 4.5 cm). In some examples, the primary drainage channel 162 has a width of between about 5 mm and about 10 mm as measured between the edge of the channel and the robot's outer rim 105. The channel 162 has a width between about 20 mm and 25 mm to the edge of the surface of the ceiling.

Figure 4B:
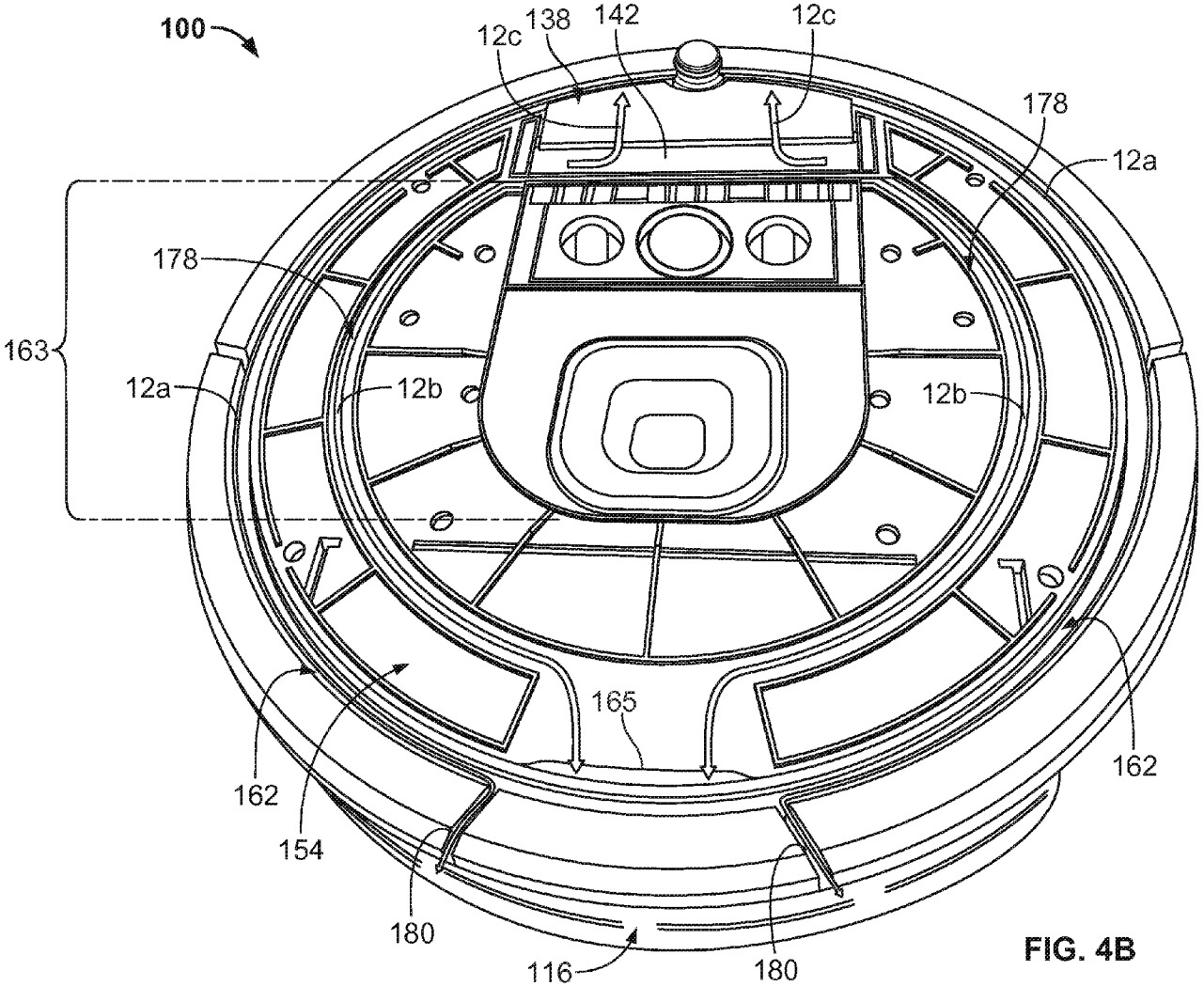
FIG. 4B is a diagram illustrating the flow of liquid through the drainage channels of the chassis ceiling.

In some examples, the base of the primary drainage channel (the lower surface 160) is substantially flat. However, in some other examples, the base is sloped, so as to cause liquid contained therein to flow off of the robot and down the sides of the robot body. In some examples, the slope of the primary drainage channel 162 as measured along a radial axis from the center of the robot is between about 5 degrees and about 10 degrees. Accordingly, when the robot 100 is in use or positioned substantially flat on the floor, liquid that reaches the primary drainage channel 162 in the front of the robot where the bumper 106 is located will flow off of the primary drainage channel 162 in an area between the robot chassis 102 and the bumper 106. For example, liquid that reaches the robot chassis near the robot's sidebrush 122 can flow off of the robot chassis along the side of the robot (e.g., past the cliff sensors 132). Thus, the liquid is directed away from the electronics that are inside the robot's chassis. In contrast, when the robot is lifted from the floor, the liquid can flow around the robot in the primary drainage channel and exit the robot near the dust bin as shown in FIG. 4B and described below.

A central area 163 of the upper surface 156 of the chassis ceiling 154 includes a plurality of circular openings 164 exposing mechanical buttons 166 engageable by a user for operating the robot 100, and a plurality of rectangular openings 168 exposing indicator lights 170 selectively illuminated by the controller circuit 128 to communicate a status of the robot to the user. The drainage channels of the chassis ceiling are configured to direct liquid away from the openings in the central area to prevent liquid from coming into contact with the circuit boards and other electronic components inside the robot chassis. The central area 163 further includes an enlarged opening 172 receiving a mounting boot 174 supporting the visual sensor 134 (e.g., a camera). In this example, the mounting boot 174 includes a sealing rim 176 that engages the inner surface of the cover 104 to inhibit or prevent ingress of dust and other foreign matter. The mounting boot 174 is formed of a unitary piece of flexible, resilient material (e.g., molded rubber) and includes an aperture for receiving the visual sensor 134. The visual sensor 134 is protected from particulate egress by the sealing rim 176 of the mounting boot 174 which extends upwardly by between 0-3 mm from the surface of the chassis ceiling 154 and from the surface of the mounting boot 174 to form a seal with the inner surface of the cover 104.

Outside the central area 163, a patterned framework of struts (e.g., struts 177*a*', 177*a*", 177*b*' and 177*b*") rises integrally from the upper surface 156 of the chassis ceiling 154. In this example, the struts 177*a*, 177*b* serve two purposes; first, to support the cover 104 under vertical loading, and second, to define a secondary drainage channel 178—located radially inward of the primary drainage channel 162—for guiding liquid that may migrate beneath the cover 104 away from the central area 163 of the chassis ceiling 154. In some examples, the struts have a height of between about 1-3 mm (e.g., between 1-2 mm), which defines the depth of the secondary drainage channel 178. Thus, the secondary drainage channel 178 has sufficient depth to channel the liquid without adding significantly to the overall height of the robot 100.

In the example shown in FIG. 4A, the upper surface 156 of the ceiling includes two sets of struts. The first set of struts includes a circular strut 177*a*' defining the inner edge of the secondary drainage channel 178 and a plurality (ten, in this example) of radial struts 177*b*' distributed along the curve of the circular strut that extend inward toward the central area 163. The second set of struts includes two laterally opposed crescent-shaped struts 177*a*", with a plurality (four, in this example) of interior radial struts 177*b*". The inner edge of the crescent-shaped struts 177*a*" forms the outer edge of the secondary drainage channel 178. Thus, the secondary drainage channel 178 is generally arcuate in shape and extends from the corners of the mounting bay 142 retaining the handle 138 to surround the central area 163. The depth of the secondary drainage channel is substantially equal to the height of defining struts (e.g., between about 1-3 mm). In some examples, the secondary drainage channel 178 has a width of between about 0.5 and 1.5 cm (e.g., 0.5-1.5 cm, 0.75-1 cm). As shown, the radial struts 177*b*" in the second set of struts are spaced at radial locations between the radial struts 177*b*' in the first set of struts. Alternating the angular locations of the radial struts can help to enhance the support of the cover 104 under vertical loading. While FIG. 4A shows ten radial struts in the first set of struts and eight (two sets of four) radial struts in the second set of struts, any suitable number of struts could be provided.

In the illustrated example, the secondary drainage channel 178 is primarily used to conduct fluid away from the central area 163 of the upper surface 156 during drainage when the robot 100 is lifted by the handle 138. However, similar to the primary drainage channel 162, the secondary drainage channel 178 may be sloped to guide liquid towards its outer edge formed by the crescent-shaped struts 177*a*" and therefore away from the central area 163 when the robot is placed on a generally flat surface, such as when the robot 100 is in use. In some examples, the slope of the secondary drainage channel 178 as measured along a radial axis from the center of the robot is between about 5 degrees and about 10 degrees. In some other examples, the secondary drainage channel 178 is substantially flat.

As shown in FIG. 4B, the flow of liquid across the ceiling 154 when the robot 100 is lifted follows the primary and secondary drainage channels 162, 178. In some examples, the outer surface of the cover 104 has a domed contour, which causes the majority of liquid deposited on top of the robot to run off the surface of the cover. Further, in some examples, the outer surface of the cover 104 includes a substantially liquid repellant component (e.g., a hydrophobic coating) that further promotes the running off of liquid from the cover. Liquid shed from the cover 104 is deposited into the primary drainage channel 162 defined in part by the exposed lower surface 160 of the chassis ceiling 154. Thus, when the robot 100 is lifted and tilted out of the horizontal plane (see FIG. 3), liquid 12*a* flows under force of gravity along the primary drainage channel 162 towards the back end 102*b* of the chassis 102 and passes through small discharge gaps 180 in the outer rim 105 between the cleaning bin release mechanism 120 and the rear wall 107. In some instances, for example, if the user lifts the robot 100 before all of the liquid has run off of the domed cover 104, some liquid may sneak under the lip of the cover at the corners of the mounting bay 142. In this case, the rogue liquid 12*b* is diverted from the central area 163 of the upper surface 156 of the chassis ceiling 154 by the secondary drainage channel 178. In this example, the secondary drainage channel 178 directs the rogue liquid 12*b* outside the central area 163 along its arcuate path to an egress region 179 toward the back end 102*b* of the chassis 102. In some examples, the egress region 179 is sloped downward (e.g., by between about 5 degrees and about 10 degrees) away from the central area 163 of the chassis ceiling 154 and towards an opening 165 leading to the interior of the cleaning bin 116. In some additional examples, the egress region 179 is substantially flat. Liquid entering the cleaning bin 116 may foul a replaceable air filter (not shown), but otherwise leave the robot 100 undamaged.

Any remaining fluid 12*c* that may flow under the handle 138 and into the mounting bay 142 is drained from the robot 100 via two drainage gutters 182 provided at the floor 144 of the mounting bay (see FIG. 5). The drainage gutters 182 are designed to convey liquid away from the communications module 136 and other liquid-sensitive components. In this example, as shown in FIG. 5, the drainage gutters 182 are provided as slots or grooves formed at opposing lateral edges of the mounting bay floor 144, equally spaced apart relative to the communications module 136. In some examples, the drainage gutters 182 are downwardly sloped (e.g., by between about 5 degrees and about 20 degrees)in the direction of the forward end 102*a* of the chassis 102, so as to guide fluid that reaches the mounting bay 142 out of the robot 100.

Figure 6A:
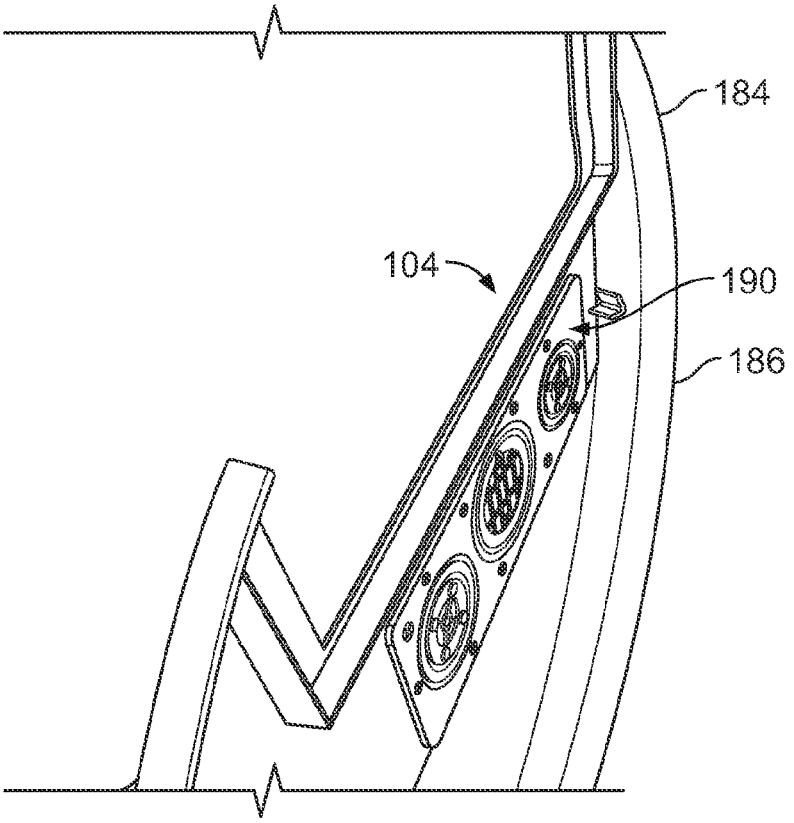
FIG. 6A is a perspective view illustrating a portion of the underside of the protective cover.
Figure 6B:
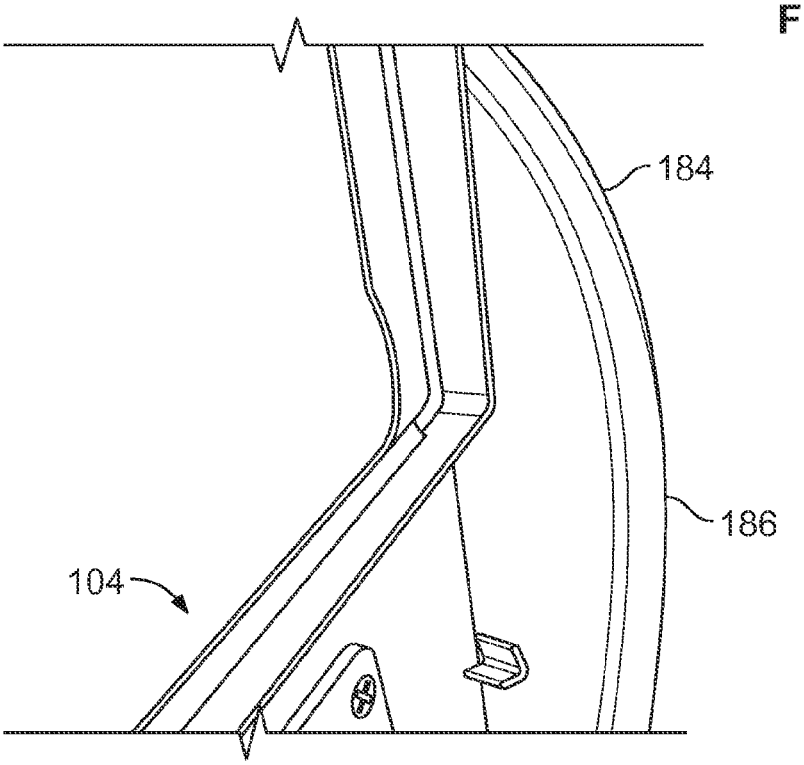
FIG. 6B is an enlarged view of the protective cover of FIG. 6A illustrating a continuous sealing lip.

As noted above, the protective cover 104 is detachably coupled to the ceiling 154 of the chassis 102. Referring to FIGS. 6A and 6B, in this example, the cover 104 is attached to the chassis ceiling 154 via a plurality (e.g., between about three and six) of locking tabs 184 distributed intermittently along the inner face of a continuous sealing lip 186 at or near the perimeter of the cover. The locking tabs 184 extend from the sealing lip 186 (e.g., by about 1-3 mm) to grip into a recess located beneath the plateaued edge 161 (see FIG. 4A) of the chassis ceiling 154 between its upper and lower surfaces 156, 160, and thus provide a snap-fit connection between the cover 104 and the chassis ceiling. With the cover 104 attached to the chassis ceiling 154, its sealing lip 186 extends below the upper surface 156 of the ceiling to inhibit the ingress of liquid beneath the cover, ensuring that the majority of the liquid is shed from its domed outer surface into the primary drainage channel 162.

Figure 7B:
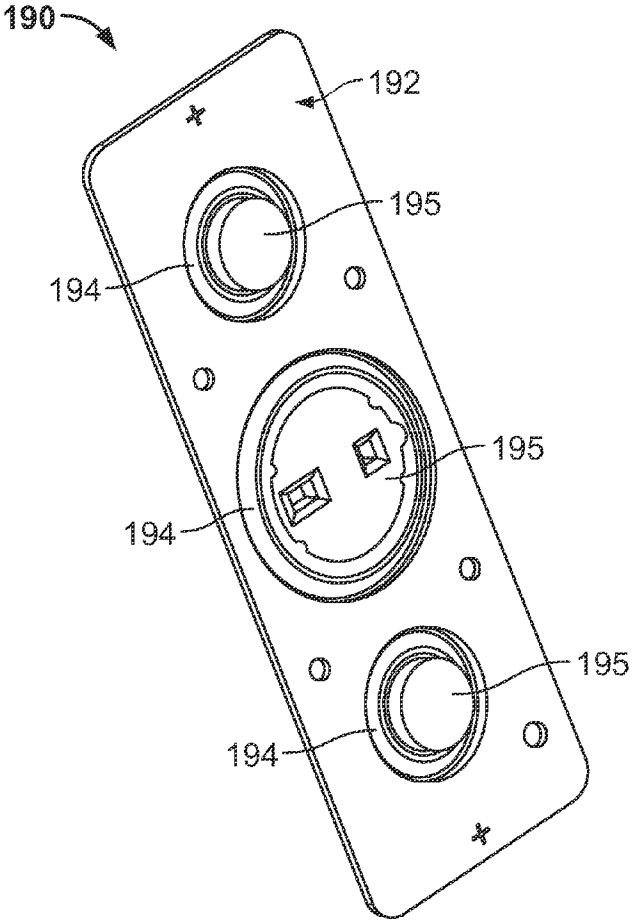
FIG. 7B is a perspective bottom view of the liquid-tight button plate.
Figure 7A:
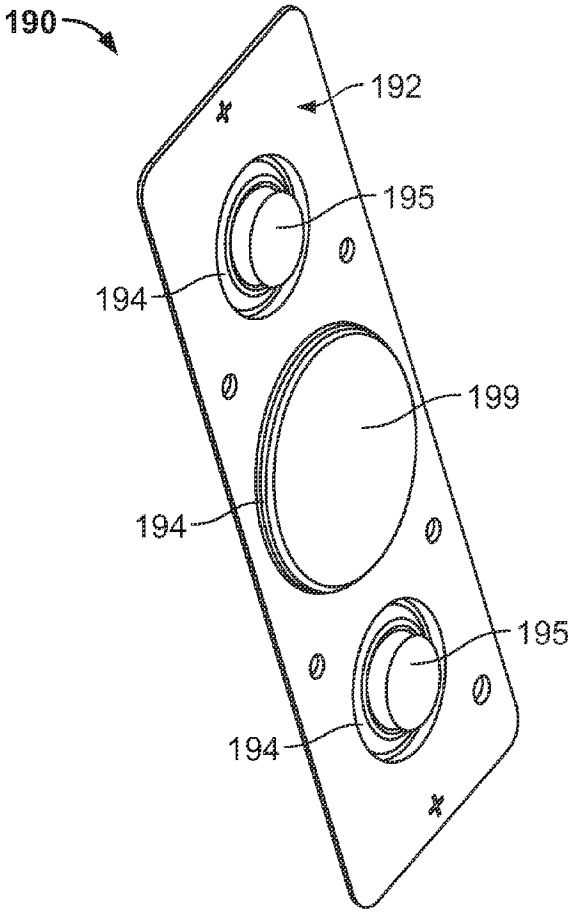
FIG. 7A is a perspective top view of a liquid-tight button plate attachable to the underside of the protective cover of FIG. 6A.
Figure 7C:
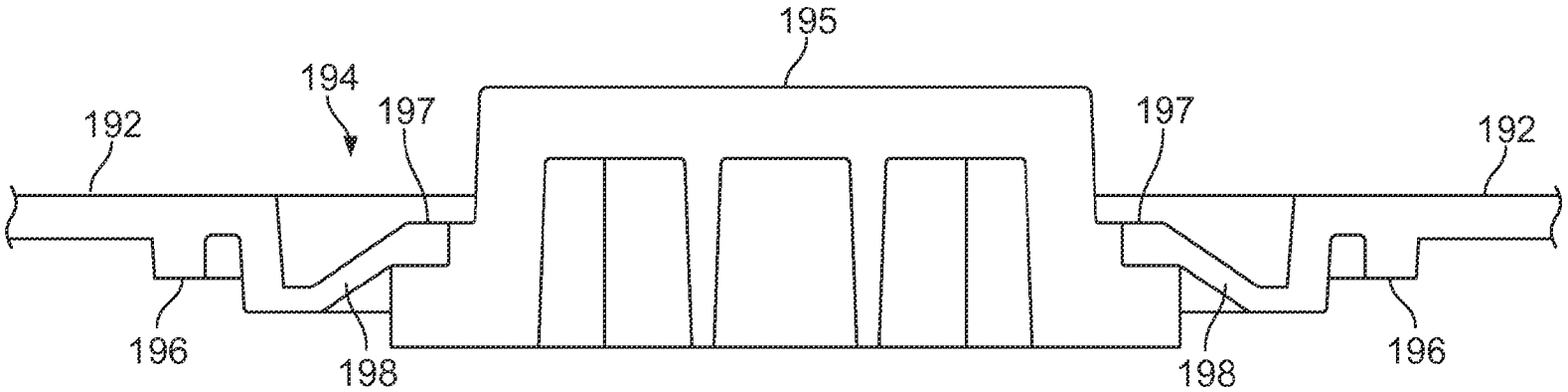
FIG. 7C is a cross-sectional side view of a portion of the liquid-tight button plate.

As shown in FIG. 6A, the protective cover 104 is fitted with a liquid-tight button plate 190 mounted to its inner surface, which faces the chassis ceiling 154 when the cover is properly coupled with the chassis ceiling 154. The button plate 190 is located on the cover 104 so as to align with the openings 164 of the chassis ceiling 154 that expose the mechanical buttons 166. As shown in FIGS. 7A-7C, the button plate 190 includes a substantially flat base 192, a plurality of grommets 194 distributed across the base, and a plurality of disks 195 retained by the respective grommets. Referring now to FIG. 7C in particular, each of the grommets 194 includes an outer flange 196, an inner flange 197, and a flexible diaphragm 198. The flexible diaphragms 198 allows the disks 195 to be pushed down into contact with the mechanical buttons (166 of FIG. 4A) in response to the press of a user. When a disk 195 is depressed, the surrounding diaphragm 198 flexes, but no fluid can seep through this flexible seal. In some examples, the disk may be formed from a substantially rigid material (e.g., a rigid plastic or metallic material) to withstand the downward force applied by a user, which ensures that the diaphragm give way as the button is pressed and not the disks. The outer and inner flanges 196, 197 support the flexible diaphragms 198 with respect to the base 192 and the disks 195, respectively. Further, the inner flanges 197 tightly grip the disks 195 to inhibit the ingress of liquid. In this example, the disks 195 are capped with button covers 199 (see FIG. 1), which may include text or symbols indicating the function of the corresponding mechanical button 166.

In some embodiments, the button plate 190 is provided in the form of a unitary structure manufactured from an elastomeric polymer material (e.g., silicone, a thermoplastic elastomer, or other appropriate thermoset). In some examples, the button-plate material has a Shore A hardness of about 10-40 (e.g., about 20). In the illustrated examples, the disks and grommets each have a circular shape and vary in size based on the corresponding openings of the chassis ceiling. In some examples, the inner flanges and the flexible diagrams are appropriately shaped and dimensioned to be received by the openings, so that the substantially rigid disks can reach the mechanical buttons beneath the ceiling. However, these components may be provided having any suitable shape or size without departing from the scope of the present disclosure.

While a number of examples have been described for illustration purposes, the foregoing description is not intended to limit the scope of the invention, which is defined by the scope of the appended claims. There are and will be other examples and modifications within the scope of the following claims.

What is claimed is:

1. An autonomous floor-traversing robot, comprising:

a wheeled body comprising a chassis and at least one motorized wheel configured to propel the chassis across a floor, the chassis defining an interior compartment disposed beneath a chassis ceiling;

a cover extending across at least a central area of the chassis ceiling; and a graspable handle connected to the chassis and located outside the cover so as to be accessible from above the robot, the handle arranged to enable lifting of the robot;

wherein the chassis ceiling defines a primary drainage channel outside the cover configured to catch liquid from an outer surface of the cover and conduct the liquid away from the central area.

2. The robot of claim 1, wherein the handle is pivotally coupled to the chassis and extends over a mounting bay defined in the chassis ceiling.

3. The robot of claim 2, wherein a floor of the mounting bay includes one or more drainage gutters to direct liquid from within the mounting bay out of the robot.

4. The robot of claim 1, wherein the handle is mounted to the chassis at a position offset from the robot's center of gravity, such that the robot tilts when lifted.

5. The robot of claim 1, wherein the chassis ceiling defines at least one secondary drainage channel extending beneath the cover and configured to conduct away from the central area.

6. The robot of claim 5, wherein the secondary drainage channel extends from a corner of a mounting bay retaining the handle.

7. The robot of claim 5, wherein the secondary drainage channel is defined by a plurality of struts extending integrally from a surface of the chassis ceiling to support the cover atop the chassis.

8. The robot of claim 5, wherein the secondary drainage channel defines an arcuate path leading across the chassis without traversing the central area.

9. The robot of claim 8, wherein the arcuate path of the secondary drainage channel leads to a downwardly sloped egress region near a back end of the chassis.

10. The robot of claim 9, wherein the egress region leads to an opening to the interior of a cleaning bin of the robot.

11. The robot of claim 5, wherein the secondary drainage channel is located radially inwards of the primary drainage channel.

12. The robot of claim 5, wherein the secondary drainage channel is downwardly sloped along a radial direction from the center of the chassis, so as to guide liquid away from the central area when the robot placed substantially flat on the floor.

13. The robot of claim 1, wherein the primary drainage channel comprises a circular race surrounding the cover.

14. The robot of claim 1, wherein the primary drainage channel comprises a recessed lower surface of the chassis ceiling traced by a raised outer rim of the body.

15. The robot of claim 14, wherein the cover is surrounded by the outer rim, and wherein the primary drainage channel is configured to conduct the liquid towards a discharge gap formed in the outer rim.

16. The robot of claim 1, wherein a lower surface of the primary drainage channel is downwardly sloped along a radial direction from the center of the chassis, so as to guide liquid to egress from the robot through an area along a side of the robot when the robot is placed substantially flat on the floor.

17. The robot of claim 1, wherein the cover is removably coupled to the chassis ceiling.

18. The robot of claim 1, wherein the cover comprises a continuous sealing lip tracing an edge of the chassis ceiling when the cover is coupled to the chassis ceiling.

19. The robot of claim 18, wherein the cover further comprises a plurality of locking tabs distributed intermittently along an inner face of the sealing lip to grip the edge of the chassis ceiling.

20. The robot of claim 1, further comprising a button plate coupled to an inner surface of the cover, the button plate comprising:

a substantially flat base;

a grommet situated within the base, the grommet comprising a flexible diaphragm; and a disk retained by an inner flange of the grommet, the disk positioned above an activatable mechanical button disposed beneath the chassis ceiling.

21. The robot of claim 1, wherein an outer surface of the cover defines a domed contour sloping downwardly toward the primary drainage channel.

22. An autonomous floor-traversing robot, comprising:

a wheeled chassis comprising a chassis housing and at least one motorized wheel configured to propel the chassis across a floor, the chassis defining an interior compartment disposed beneath a chassis ceiling;

a cover extending across at least a central area of the chassis ceiling; and a graspable handle connected to the chassis and located outside the cover so as to be accessible from above the robot, the handle arranged to enable lifting of the robot;

wherein the chassis ceiling has an upper surface defining one or more open drainage channels extending beneath the cover from a corner of a mounting bay retaining the handle and configured to conduct liquid toward an edge region of the robot.

23. The robot of claim 22, wherein at least one of the drainage channels is defined by a plurality of struts extending integrally from a surface of the chassis ceiling to support the cover atop the chassis.

24. The robot of claim 22, wherein at least one of the drainage channels defines an arcuate path leading across the chassis without traversing the central area.

25. The robot of claim 24, wherein the arcuate path leads to a downwardly sloped egress region near a back end of the chassis.

26. The robot of claim 25, wherein the egress region leads to an opening to the interior of a cleaning bin of the robot.

27. The robot of claim 22, wherein at least one of the drainage channels is located radially inwards of a primary drainage channel outside the cover configured to catch liquid from an outer surface of the cover and conduct the liquid away from the central area.

28. The robot of claim 22, wherein at least one of the drainage channels is downwardly sloped along a radial direction from the center of the chassis, so as to guide liquid away from the central area when the robot placed substantially flat on the floor.

* * * * *